US007741784B2

(12) United States Patent
Paeng et al.

(10) Patent No.: US 7,741,784 B2
(45) Date of Patent: Jun. 22, 2010

(54) APPARATUS FOR DRIVING A LIGHT SOURCE AND LIQUID CRYSTAL DISPLAY DEVICE USING THE SAME

(75) Inventors: Sang Won Paeng, Daegu (KR); Sang Soo Han, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 11/878,298

(22) Filed: Jul. 23, 2007

(65) Prior Publication Data

US 2008/0136352 A1 Jun. 12, 2008

(30) Foreign Application Priority Data

Dec. 11, 2006 (KR) ..... 10-2006-0125846

(51) Int. Cl.
*H05B 39/10* (2006.01)

(52) U.S. Cl. ..... 315/90; 315/312

(58) Field of Classification Search ..... 315/86–93, 315/209 R, 210, 246, 247, 291, 294, 295, 315/297, 299, 300, 301, 308, 307, 312, 360
See application file for complete search history.

(56) References Cited

U.S. PATENT DOCUMENTS 6,943,506 B2 * 9/2005 Moon ..... 315/323
2006/0119294 A1 * 6/2006 Oh et al. ..... 315/312

* cited by examiner

*Primary Examiner*—Douglas W Owens
*Assistant Examiner*—Jianzi Chen
(74) *Attorney, Agent, or Firm*—McKenna Long & Aldridge LLP

(57) ABSTRACT

An apparatus for driving a light source and a liquid crystal display device using the same is disclosed. The apparatus for driving a light includes: a light source unit including a plurality of lamps to emit light; and a light source driving unit that selectively drives the plurality of lamps in response to a luminance control signal and a selection signal.

6 Claims, 3 Drawing Sheets

APPARATUS FOR DRIVING A LIGHT SOURCE AND LIQUID CRYSTAL DISPLAY DEVICE USING THE SAME

This application claims the benefit of Korean Patent Application No. 2006-125846 filed on Dec. 11, 2006, which is hereby incorporated by reference for all purposes as if fully set forth herein.

BACKGROUND OF THE INVENTION

1. Field of the Invention

The present invention relates to a liquid crystal display (LCD) device, and more particularly, to an apparatus for driving a light source that increases the variable range of luminance and decreases power consumption.

2. Discussion of the Related Art

A liquid crystal display (LCD) device displays images using the electrical and optical properties of liquid crystal. A typical LCD device includes an LCD panel that displays images using a pixel matrix, and a driving circuit that drives the LCD panel. As LCD panels do not emit light, a backlight unit is provided to transmit light into the LCD panel to produce a viewable image. The LCD panel controls the transmittance of light emitted by the backlight unit by changing the alignment of liquid crystal according to a data signal applied to each sub pixel of the pixel matrix to thereby display images.

Backlight units may be broadly classified as either edge type or direct type units. In case of the edge type backlight unit, a light source is provided at a lateral side of a light-guiding plate and light emitted from lamps is supplied to the LCD panel through a light-guiding plate and a plurality of diffusion sheets. The direct type backlight unit is typically used with large-sized LCD panels and includes a plurality of light sources arranged at regular intervals at a lower surface of LCD panel to supply light to the entire lower surface of LCD panel.

The light source of the backlight unit may include a cylindrically shaped lamp such as a Cold Cathode Fluorescent Lamp (CCFL) or an External Electrode Fluorescent Lamp (EEFL). An EEFL lamp has electrodes formed externally to a cylindrical tube. The lamp of the backlight unit is driven by an inverter that supplies a tube current by changing a DC driving voltage to an AC driving voltage and stepping up the level of the AC driving voltage.

When used with large sized LCD devices, an edge type backlight unit typically uses a plurality of lamps. However, since the plurality of lamps provided in the related art LCD devices are driven by a single inverter, the variable range of luminance emitted from the lamps is limited, and power consumption is relatively high even in applications that display text and that do not need the higher luminance used for displaying moving images.

SUMMARY OF THE INVENTION

Accordingly, the present invention is directed to an apparatus for driving a light source and a liquid crystal display device using the same that substantially obviates one or more of the problems due to limitations and disadvantages of the related art.

An advantage of the present invention is to provide an apparatus of driving a light source to increase the variable range of luminance and to decrease the power consumption, and a liquid crystal display device using the same.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a light source driving apparatus includes: a light source unit including a plurality of lamps to emit light; and a light source driving unit that selectively drives the plurality of lamps in response to a luminance control signal and a selection signal.

In another aspect of the present invention, a liquid crystal display (LCD) device includes: an LCD panel that displays images; a light source unit including a plurality of lamps to supply light to the LCD panel; and a light source driving unit that selectively drives the plurality of lamps in response to a luminance control signal and a selection signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, examples of which are illustrated in the accompanying drawings. Wherever possible, the same reference numbers will be used throughout the drawings to refer to the same or like parts.

Hereinafter, a light source driving apparatus according an embodiment of the present invention and a liquid crystal display (LCD) device using the same will be explained with reference to FIGS. 1 to 3.

Figure 1:
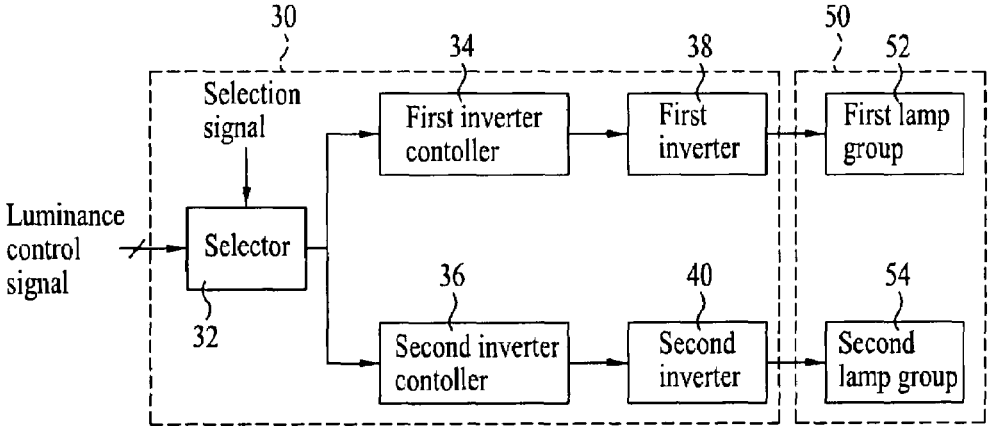
FIG. 1 is a block diagram illustrating a light source driving apparatus of a liquid crystal display (LCD) device according to an embodiment of the present invention.

FIG. 1 is a block diagram illustrating a light source driving apparatus of an LCD device according to an embodiment of the present invention.

As shown in FIG. 1, the light source driving apparatus according to an embodiment of the present invention includes a light source unit 50 including first and second lamp groups 52 and 54 having a plurality of lamps; and a light source driving unit 30 that separately drives the first and second lamp groups 52 and 54 of the light source unit 50. While FIG. 1 shows two lamp groups, the invention is not limited to embodiments using only two lamp groups. However, for convenience of explanation, an example case utilizing two lamp groups will be described hereinafter. Each of the first and second lamp groups 52 and 54 may be provided with a single lamp, or may alternately include a plurality of lamps.

The light source driving unit 30 is supplied with an inverter selection signal and a luminance control signal from an external luminance controller and the light source driving unit 30 drives both or a respective one of the first and second lamp groups 52 and 54. To accomplish this driving function, the light source driving unit 30 includes first and second inverters 38 and 40 that respectively drive the first and second lamp groups 52 and 54; first and second inverter controllers 34 and 36 that respectively control the first and second inverters 38 and 40; and a selector 32 that selects between supplying input signals simultaneously to both of the first and second inverter controllers 34 and 36 and supplying an input signal to a respective one of the first and second inverter controllers 34 and 36. The luminance controller may be integrated into a timing controller of a display device. The luminance controller outputs the luminance control signal and the inverter selection signal according to whether the images to be displayed correspond to moving images or still images, or alternately in response to input from a user.

In response to the inverter selection signal from the luminance controller, the selector 32 selectively supplies first and second luminance control signals either to both of the first and second inverter controllers 34 and 36 simultaneously, or to a selected one of the first and second inverter controllers 34 and 36. For example, when displaying the moving images or otherwise using the maximum luminance available from the light source unit 50, the selector 32 simultaneously supplies the first and second luminance control signals to each of the first and second inverter controllers 34 and 36 in response to the inverter selection signal to drive the first and second inverters 38 and 40 concurrently or simultaneously. The first and second luminance control signals may be provided with the same signal or the different signals. By providing differing first and second luminance control signals, it is possible to vary the luminance for each of the first and second lamp groups 52 and 54 independently, thereby increasing the range of variation of luminance obtainable from the light source unit 50. On the other hand, when displaying still images such as text or when otherwise using a minimum luminance from the light source unit, the selector 32 supplies one of the first and second luminance control signals to a single, selected one of the first and second inverter controllers 34 and 36. Accordingly, a respective one of the first and second inverters 38 and 40 is driven, while the other of the first and second inverters 38 and 40 is not driven so that power consumption of the light unit 50 may be reduced.

When the first luminance control signal is supplied to the first inverter controller 34 through the selector 32, the first inverter controller 34 controls the first inverter 38 in response to the first luminance control signal to thereby control a driving voltage of first lamp group 52. Similarly, when the second luminance control signal is supplied to the second inverter controller 36 through the selector 32, the second inverter controller 36 controls the second inverter 40 in response to the second luminance control signal to thereby control a driving voltage of second lamp group 54. For example, the first and second inverter controllers 34 and 36 may change the pulse width of pulse-width modulation signals generated in the respective first and second inverters 38 and 40 in response to the corresponding luminance control signal to thereby control the driving voltage of first and second inverters 38 and 40.

The first inverter 38 outputs the first lamp driving voltage controlled by the first inverter controller 34 to the first lamp group 52. The second inverter 40 outputs the second lamp driving voltage controlled by the second inverter controller 36 to the second lamp group 54. Each of the first and second inverters 38 and 40 includes a pulse-width modulation circuit that outputs the pulse-width modulation signal in response to the control of first and second inverter controllers 34 and 36; a switch that switches an external DC voltage to an AC voltage on the basis of the pulse-width modulation signal; and a transformer that steps up the AC voltage from the switch, and outputs the stepped up AC voltage as the lamp driving voltage.

The first and second lamp groups 52 and 54 each emit light having a luminance corresponding to a tube current that is proportional to the lamp driving voltage applied to the respective lamp group. The first and second lamp groups 52 and 54 may be driven simultaneously or a selected one of the first and second lamp groups 52 and 54 may be driven. The lamps of first and second lamp groups 52 and 54 may include CCFLs or EEFLs. The first and second lamp groups 52 and 54 may be used as either an edge type or direct type backlight unit. When the first and second lamp groups 52 and 54 are employed as edge type backlight unit, the first and second lamp groups 52 and 54 may be positioned opposite a single side of light-guiding plate, or alternatively the first and second lamp groups 52 and 54 may be positioned at opposite sides of a light-guiding plate. When the first and second lamp groups 52 and 54 are applied in a direct type backlight unit, the plurality of first and second lamps included in the first and second lamp groups 52 and 54 are arranged in parallel along an entire light receiving surface at the rear of an LCD panel.

The light source driving apparatus according to an embodiment of the present invention selectively controls the first and second inverter controller 34 and 36 through the selector. As a result, it is possible to increase the range of variation of luminance from the light source by driving the first and second lamp groups 52 and 54 simultaneously, and to decrease the power consumption by driving a selected one of the first and second lamp groups 52 and 54.

Figure 2:
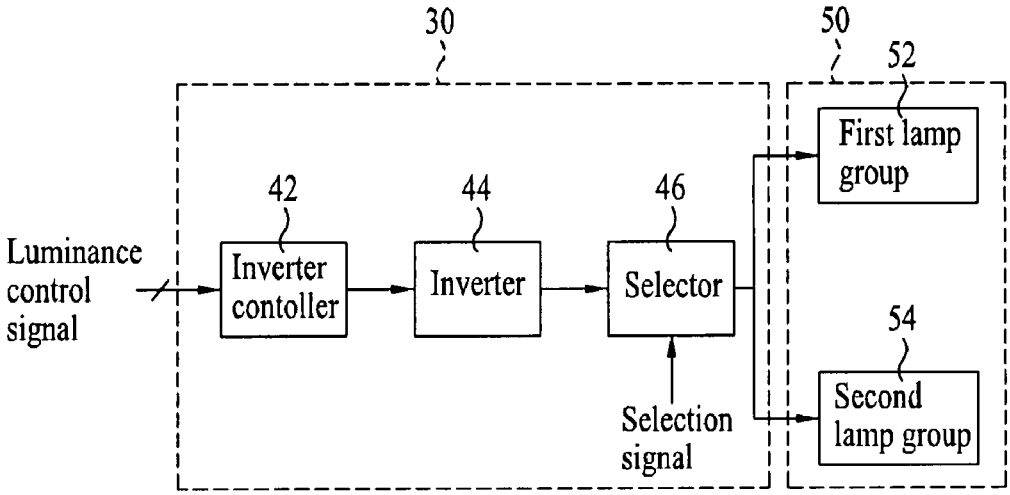
FIG. 2 is a block diagram illustrating a light source driving apparatus according to another embodiment of the present invention.

FIG. 2 is a block diagram illustrating a light source driving apparatus of an LCD device according to another embodiment of the present invention.

As shown in FIG. 2, a light source driving apparatus according to an embodiment of the present invention includes a light source unit 50 provided with first and second lamp groups 52 and 54; and a light source driving unit 30 provided with an inverter controller 42, an inverter 44, and a selector 46 to separately drive the first and second lamp groups 52 and 54 of the light source unit 50.

The invention may be practiced with a number of lamp groups included in the light source unit 50 other than two. However, for convenience of explanation, an example using two lamp groups will be described in detail hereinafter.

Each of the first and second lamp groups 52 and 54 may be provided with one lamp, or a plurality of lamps. The lamps of first and second lamp groups 52 and 54 are typically CCFLs or EEFLs. In addition, the first and second lamp groups 52 and 54 may be used as either an edge type or a direct type backlight unit. When the first and second lamp groups 52 and 54 are employed as edge type backlight unit, the first and second lamp groups 52 and 54 may be positioned opposite a single side of light-guiding plate, or may alternative the first and second lamp groups 52 and 54 may be adjacent to opposite sides of a light-guiding plate. When the first and second lamp groups 52 and 54 are applied in a direct type backlight unit, the plurality of first and second lamps included in the first and second lamp groups 52 and 54 are arranged in parallel along an entire light receiving surface at the rear of an LCD panel.

The light source driving unit 30 is supplied with a luminance control signal from an external luminance controller and a lamp selection signal and the first and second lamp groups 52 and 54 of the light source unit 50 may be driven simultaneously or a selected one of the first and second lamp groups 52 and 54 may be driven. For the purpose of driving the lamp groups 52 and 54 as described, the light source driving unit 30 includes the inverter controller 42, the inverter 44, and the selector 46.

The luminance controller may be integrated into a timing controller. The luminance controller outputs the luminance control signal and lamp selection signal according to whether the displayed images correspond to moving images or still images, or in response to input from a user.

The inverter controller 42 controls the inverter 44 according to the luminance control signal to thereby control a lamp driving voltage.

The inverter 44 supplies the lamp driving voltage controlled by the inverter controller 42 to the selector 46. The inverter 44 includes a pulse-width modulation circuit that outputs a pulse-width modulation signal in response to the control of inverter controller 42; a switch that converts an external DC voltage to an AC voltage in response to the pulse-width modulation signal from the pulse-width modulation circuit; and a transformer that steps up the AC voltage from the switch, and outputs the stepped up AC voltage as the lamp driving voltage.

In response to the lamp selection signal from the luminance controller, the selector 46 supplies the lamp driving voltage from the inverter 44 to the first and second lamp groups 52 and 54 simultaneously or to a selected one of the first and second lamp groups 52 and 54. Accordingly as the first and second lamp groups 52 and 54 are driven simultaneously or selectively, one or both of the first and second lamp groups 52 and 54 emit light using a tube current generated in proportion to the lamp driving voltage.

The light source driving apparatus according to the present invention selectively controls the first and second inverter controller 34 and 36 using the selector 32. As a result, it is possible to increase the range of variation of luminance by driving the first and second lamp groups 52 and 54 simultaneously or concurrently, and to decrease the power consumption by selectively driving a respective, selected one of the first and second lamp groups 52 and 54.

Figure 3:
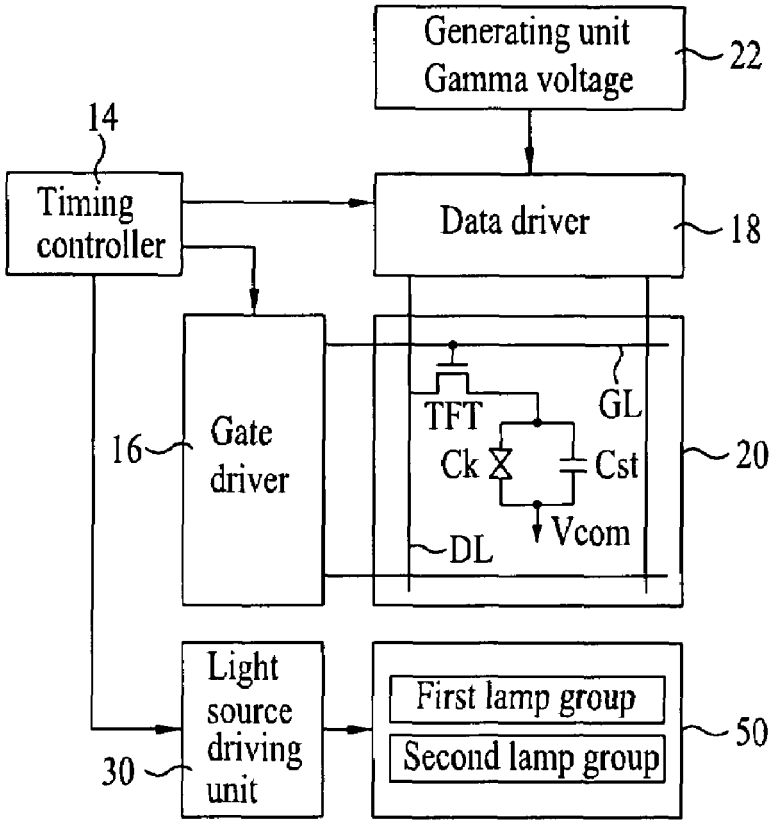
FIG. 3 is a block diagram illustrating an LCD device according to an embodiment of the present invention.

FIG. 3 is a block diagram illustrating an LCD device employing a light source driving apparatus according to an embodiment of the present invention.

As shown in FIG. 3, an LCD device according to an embodiment of the present invention includes an LCD panel 20; a gate driver 16 that drives gate lines GL of the LCD panel 20; a data driver 18 that drives data lines DL of the LCD panel 20; a gamma voltage generating unit 22 that generates gamma voltages and supplies the generated gamma voltages to the data driver 18; a timing controller 14 that controls the data driver 18 and the gate driver 16; a light source unit 50 that supplies light to the LCD panel 20; and a light source driving unit 30 that selectively drives the light source unit 50 that includes a plurality of lamp groups.

The timing controller 14 arranges data signals supplied from a source external to the LCD device, and supplies the arranged data signals to the data driver 18. In addition, the timing controller 14 generates a plurality of control signals to control the driving timing of the gate and data drivers 16 and 18 using a dot clock DCLK, a data enable signal DE, and horizontally and vertically synchronized signals H and V. The timing controller 14 additionally generates a luminance control signal and a selection signal (inverter or lamp selection signal) in response to the data signal or user's control, and supplies the generated luminance control signal and selection signal to the light source driving unit 30.

The gamma voltage generating unit 22 generates a plurality of gamma voltages according to a plurality of gray scales by dividing a gamma driving voltage from a power source, and supplies the generated gamma voltages to the data driver 18.

The data driver 18 selects the gamma voltages supplied from the gamma voltage generating unit 22 according to the digital data signal from the timing controller 14, and supplies the selected ones to the data lines DL of the LCD panel 20. The data driver 18 selects a gamma voltage of positive polarity or negative polarity (referenced to $V_{com}$) according to a polarity control signal from the timing controller 14, and supplies the selected gamma voltage as an analog data signal to the data line DL of the LCD panel. The data driver 18 and the gamma voltage generating unit 22 may be integrated into one driving chip.

The gate driver 16 generates scan signals in response to control signals from the timing controller 14, and supplies the generated scan signals to the gate lines GL of the LCD panel 20. The gate driver 16 selects a gate-on voltage of power source in response to the control signals from the timing controller 14, and outputs the selected gate-on voltage as the scan signal to the gate line GL. The gate driver 16 selects a gate-off voltage at the other periods, and supplies the selected gate-off voltage to the gate line GL.

The LCD panel 20 includes a liquid crystal cell Clc formed in a sub pixel region defined by the gate and data lines GL and DL crossing each other; and a thin film transistor TFT connected among the gate line GL, the data line DL, and the liquid crystal cell Clc. The thin film transistor TFT supplies the analog data signal on data line DL to the liquid crystal cell Clc in response to the gate-on voltage of the scan signal on gate line GL. The liquid crystal cell Clc is charged with a pixel voltage that corresponds to a differential voltage between the supplied data signal and a common voltage $V_{com}$. Thus, the liquid crystal cell Clc controls the light transmittance in a sub-pixel by driving liquid crystal according to the charged pixel voltage. A storage capacitor Cst is additionally connected in parallel with the liquid crystal cell Clc to stably maintain the pixel voltage charged in the liquid crystal cell Clc until a new pixel voltage is supplied to the liquid crystal cell Clc.

In response to the luminance control signal and selection signal (inverter or lamp selection signal) from the timing controller 14, the light source driving unit 30 selectively drives the first and second lamp groups 52 and 54.

For example, as shown in FIG. 1, the light source driving unit 30 is provided with the first and second inverters 38 and 40 that respectively drive the first and second lamp groups 52 and 54 of light source unit 50; the first and second inverter controllers 34 and 36 that respectively control the first and second inverters 38 and 40; and the selector 32 that controls input signals to the first and second inverter controllers 34 and 36. The light source driving unit 30 controls the driving of first and second inverter controllers 34 and 36 by the selector 32 that responds to the inverter selection signal from the timing controller 14. Thus, the range of variation of luminance may be increased by simultaneously driving the first and second lamp groups 52 and 54, or the power consumption may be decreased by driving a selected one of the first and second lamp groups 52 and 54.

As shown in FIG. 2, the light source driving unit 30 may be provided with the inverter controller 42 and inverter 44 that output the lamp driving voltage in response to the luminance control signal from the timing controller 14; and the selector 46 that simultaneously or selectively supplies the lamp driving voltage from the inverter 44 to the first and second lamp groups 52 and 54 in response to the lamp selection signal from the timing controller 14. The light source driving unit 30 may increase the range of variation of luminance by simultaneously driving the first and second lamp groups 52 and 54 through the selector 46, or may decrease the power consumption by selectively driving one of the first and second lamp groups 52 and 54.

The first and second lamp groups 52 and 54 emit light having luminance corresponding to a tube current that is proportional to the lamp driving voltage from the light source driving unit 30. The first and second lamp groups 52 and 54 may be driven simultaneously or selectively. The lamps included in the first and second lamp groups 52 and 54 are generally formed of CCFLs or EEFLs. The first and second lamp groups 52 and 54 may be employed in either an edge or a direct type backlight unit. Each of the first and second lamp groups 52 and 54 may be provided with one lamp, or the plurality of lamps.

As described above, the light source driving apparatus according to the present invention has the following advantages.

The light source driving apparatus and the LCD device using the same according to the current invention drive the plurality of lamps simultaneously or selectively so that it is possible to increase the range of variance of luminance and to decrease the power consumption.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light source driving apparatus comprising:

a light source unit including a plurality of lamps to emit light, wherein the plurality of lamps are divided into a plurality of lamp groups; and a light source driving unit that selectively drives the plurality of lamps in response to a luminance control signal and a selection signal, wherein the light source driving unit drives all the plurality of lamp groups for a maximum luminance, while the light source driving unit drives one of the plurality of lamp groups for a minimum luminance, wherein the light source driving unit includes:

a plurality of inverters that each drive a respective one of the lamp groups, a plurality of inverter controllers that each control a respective one of the inverters, and a selector that selects between supplying inverter control signals simultaneously to the plurality of inverter controllers and supplying an inverter control signal to a respective one of the plurality of inverter controllers in response to the selection signal.

2. The light source driving apparatus of claim 1, wherein the selector selects between supplying inverter control signals having substantially a same luminance control value simultaneously to the plurality of inverter controllers and supplying an inverter control signal to a respective one of the plurality of inverter controllers in response to the selection signal.

3. The light source driving apparatus of claim 1, wherein the selector selects between supplying inverter control signals having different luminance control values simultaneously to the plurality of inverter controllers and supplying an inverter control signal to a respective one of the plurality of inverter controllers in response to the selection signal.

4. A liquid crystal display (LCD) device comprising:

an LCD panel that displays images;

a light source unit including a plurality of lamps to supply light to the LCD panel, wherein the plurality of lamps are divided into a plurality of lamp groups; and a light source driving unit that selectively drives the plurality of lamps in response to a luminance control signal and a selection signal, wherein the light source driving unit drives all the plurality of lamp groups for a maximum luminance, while the light source driving unit drives one of the plurality of lamp groups for a minimum luminance, wherein the light source driving unit includes:

a plurality of inverters that each drive a respective lamp group of the plurality of the lamp groups, a plurality of inverter controllers that each control a respective inverter of the plurality of inverters, and a selector that selects between supplying inverter control signals simultaneously to the plurality of inverter controllers and supplying an inverter control signal to a respective one of the plurality of inverter controllers in response to the selection signal.

5. The LCD device of claim 4, wherein the plurality of inverter controllers are each supplied with a same luminance control signals.

6. The LCD device of claim 4, wherein the plurality of inverter controllers are each supplied with different luminance control signals.

* * * * *